US011089823B2

(12) United States Patent
Chuah

(10) Patent No.: US 11,089,823 B2
(45) Date of Patent: Aug. 17, 2021

(54) BIB FOR SMALL CHILD

(71) Applicant: Khai Gan Chuah, Austin, TX (US)

(72) Inventor: Khai Gan Chuah, Austin, TX (US)

( * ) Notice: Subject to any disclaimer, the term of this patent is extended or adjusted under 35 U.S.C. 154(b) by 13 days.

(21) Appl. No.: 16/231,492

(22) Filed: Dec. 22, 2018

(65) Prior Publication Data

US 2020/0196682 A1 Jun. 25, 2020

(51) Int. Cl.
*A41B 13/10* (2006.01)
*A44B 17/00* (2006.01)

(52) U.S. Cl.
CPC ..... *A41B 13/103* (2013.01); *A44B 17/0076* (2013.01)

(58) Field of Classification Search
CPC ..... A41B 13/10; A41B 13/103; A41B 13/106
USPC ..... D2/863, 864, 861, 860
See application file for complete search history.

(56) References Cited

U.S. PATENT DOCUMENTS 453,490 A * 6/1891 Kropp ..... A41B 13/103 2/49.2
2,389,596 A * 11/1945 Charnas ..... A45D 44/08 224/623
3,407,407 A 10/1968 Smith et al.
D216,291 S 12/1969 Korshak
3,540,060 A * 11/1970 Brown ..... A41B 13/103 2/49.2
D307,070 S 4/1990 Wymer
4,924,527 A * 5/1990 Hintermeyer ..... A41B 13/103 2/46
5,218,721 A 6/1993 Mathews et al.
5,504,941 A 4/1996 Sell
D383,891 S 9/1997 Hill
D394,339 S 5/1998 Hill
5,765,225 A * 6/1998 Goeckeritz ..... A41B 13/10 2/49.1
5,911,311 A * 6/1999 Hutchins ..... A41B 13/10 2/48
6,481,016 B1 11/2002 Rees
D493,024 S 7/2004 Bergkvist
D530,887 S 10/2006 Harless
D540,511 S 4/2007 Toomer
D541,012 S 4/2007 Gottehrer
7,269,857 B2 9/2007 Cymbol
D591,484 S 5/2009 Lindh
D648,509 S 11/2011 Hansen et al.
D661,468 S 6/2012 Michaels et al.
(Continued)

FOREIGN PATENT DOCUMENTS

GB 2378634 A * 2/2003 ..... A41B 13/103
WO WO-2008020197 A1 * 2/2008 ..... A41B 13/103

OTHER PUBLICATIONS

OXO, OXO Tot Roll-Up Bib, Nov. 29, 2017, www.youtube.com, https://www.youtube.com/watch?v=t_lk7PyFh4 (Year: 2017).*
(Continued)

*Primary Examiner* — Alissa J Tompkins
*Assistant Examiner* — Brieanna Szafran
(74) *Attorney, Agent, or Firm* — Craige Thompson; Thompson Patent Law; Timothy D. Snowden

(57) ABSTRACT

A bib comprising a locking compartment specifically to engage and secure a protruding connector located on the pocket of the bib, with means to secure the bib in a folded position for storage ability, as well as preventing spillage of contaminants.

16 Claims, 10 Drawing Sheets

(56) References Cited

U.S. PATENT DOCUMENTS

| | | | | |
|---|---|---|---|---|
| D698,130 | S * | 1/2014 | Worden, IV | D2/864 |
| D699,926 | S | 2/2014 | Sakanishi | |
| 9,226,529 | B2 | 1/2016 | Monahon | |
| D758,051 | S | 6/2016 | Feeley et al. | |
| 9,392,821 | B1 | 7/2016 | Baker | |
| D811,700 | S | 3/2018 | D'Amato-Friedman | |
| D825,897 | S | 8/2018 | Apeatro et al. | |
| D879,413 | S | 3/2020 | Ejvinsson et al. | |
| D881,531 | S | 4/2020 | McAdams | |
| D903,985 | S * | 12/2020 | Cannon | D2/864 |
| 2002/0069446 | A1 * | 6/2002 | Pinckney | A41B 13/10 2/49.1 |
| 2005/0028239 | A1 | 2/2005 | Rees | |
| 2006/0000002 | A1 | 1/2006 | Bergkvist | |
| 2007/0143904 | A1 | 6/2007 | Brown | |
| 2014/0325797 | A1 * | 11/2014 | Hasegawa | A44B 17/0011 24/108 |
| 2017/0303602 | A1 * | 10/2017 | Petersen | A47G 19/08 |

OTHER PUBLICATIONS

Foreign Office Action in related Japan Application No. 20190006245, dated Nov. 11, 2019, 4 pages.

Khai Gan Chuah, Child's Bib, Design U.S. Appl. No. 29/664,644, filed Sep. 27, 2018.

Machine translation of Japanese Office Action, translated on Mar. 24, 2020, using Google translate, https://www.google.com/search?q=google+translate&rlz=1C1CHBF_enUS891US891&oq=google+transl&aqs=chrome.0.0j69i57j0l4j69i60l2.4881j0j7&sourceid=chrome&ie=UTF-8.

* cited by examiner

BIB FOR SMALL CHILD

CROSS-REFERENCE TO RELATED APPLICATIONS

This application claims priority to U.S. Provisional Application Ser. No. 67/758,669 filed Nov. 11, 2018. The instant application shares common inventorship and subject matter with U.S. application Ser. No. 29/664,644 filed Sep. 27, 2018 and issued as U.S. Pat. No. D910,982 on Feb. 23, 2021; U.S. application Ser. No. 29/767,659 filed on Jan. 25, 2021; European application number EP19179943A filed Jun. 13, 2019; Korean application number KR20190004250U filed Oct. 21, 2019; Japanese application number JP2019192589A filed Oct. 23, 2019; and Chinese application number CN201910797363A filed Aug. 27, 2019.

BACKGROUND OF THE INVENTION

1. Field of the Invention

This invention relates to foldable bib for babies, where the bib comes with a locking compartment to secure firmly when it is folded.

2. Discussion of Prior Art

It is common for parents to carry bibs when planning for possible feeding their babies outside of home. The method of storage is important since improper of storage may result in contamination, cleanliness and excess space consumption in the diaper bag. This invention focuses on a foldable bib where the bib can be folded and secured in a folded position to minimize space, while protecting the inner contents from spillage. In order to avoid putting excess weight on the small child, baby bib in general is designed to be in lightweight. For baby bib that comprises of semi-rigid material such as plastic or silicon, the bib is generally heavier than the traditional cloth material. Therefore, to avoid burdening the baby with heavy bib, the thickness of the bib is minimized. The design patent U.S. Pat. No. D698,130 discloses a baby's bib in which when folded, the connector snaps onto the edge of the hole on the pocket to secure a folded position. The thickness limitation in overall structure reduces the durability and reliability of the edge of the hole. Over time, the repetitive movements of pulling or twisting causes wear and tear to the hole. In addition, the hole of the bib is located along the pocket of the bib. This may cause unnecessary food or fluid spillage which again causes discomfort to the small child. It would be desirable to be able to provide a reliable locking mechanism for infant's bib that can increase its life cycle while providing a strong locking system that is easy to use and manufacture. In addition, it will alleviate discomfort on small child and unnecessary spillage.

SUMMARY OF INVENTION

The present invention relates generally to a locking mechanism on bib comprising a locking compartment specifically to engage and secure a protruding connector located on the pocket of the bib, with means to secure the bib in a folded position for storage ability, as well as preventing spillage of contaminants. This is accomplished by designing a standout locking compartment to perform tight encasement in securing the protruding connector. The thickness of locking compartment is independent from bib and can be design in various levels of thickness without affecting the overall structure of the bib. The invention also focuses on the protruded connector being in a position away from body contact with baby to prevent any skin irritation. The locking mechanism eliminates bole on the surface of pocket and hence prevents any spillage of food when in open or folded position.

DETAILED DESCRIPTION OF INVENTION

Figure 1:
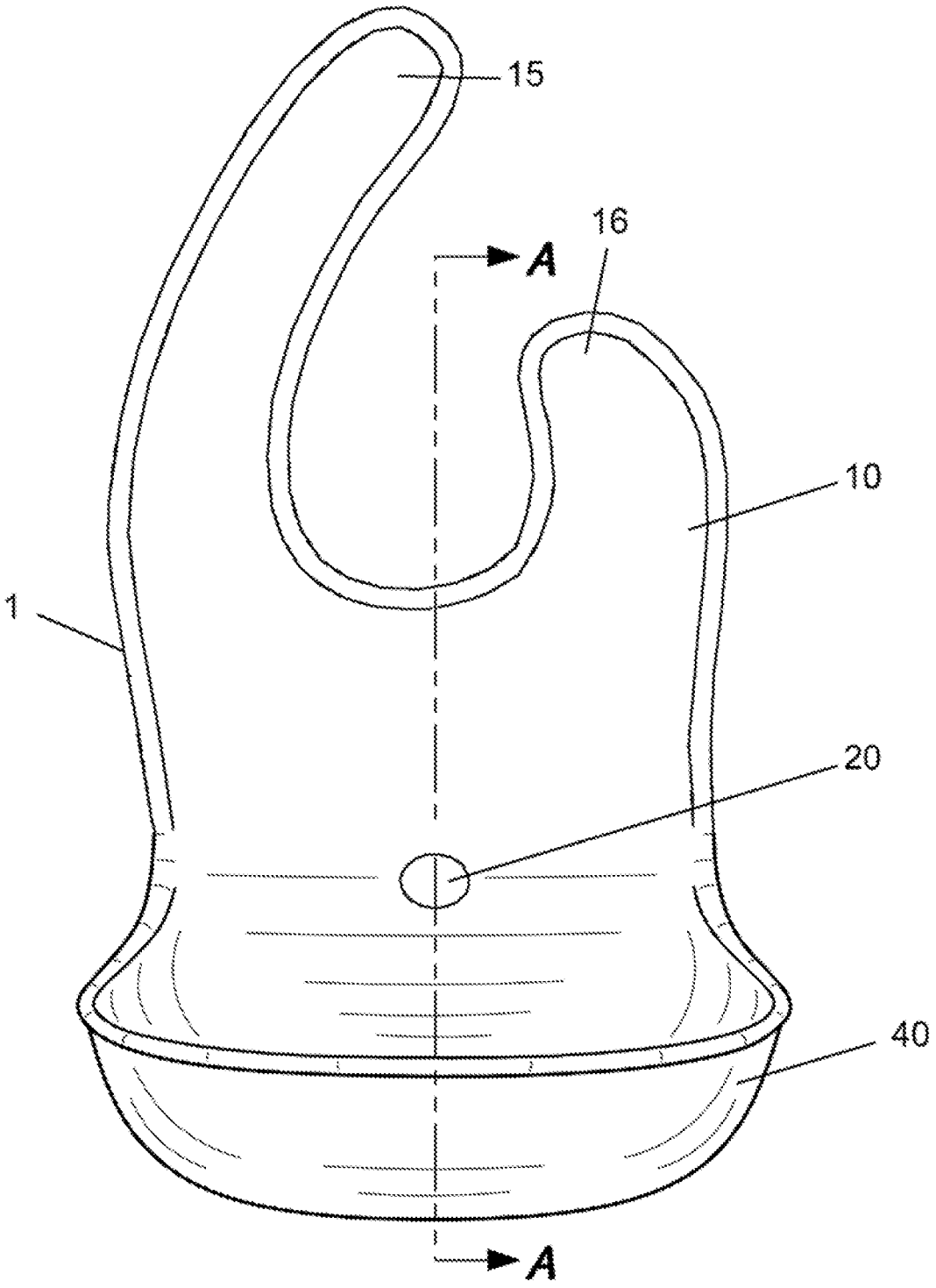
FIG. 1 is a front view of the bib according the invention showing the position of the locking compartment.
Figure 2:
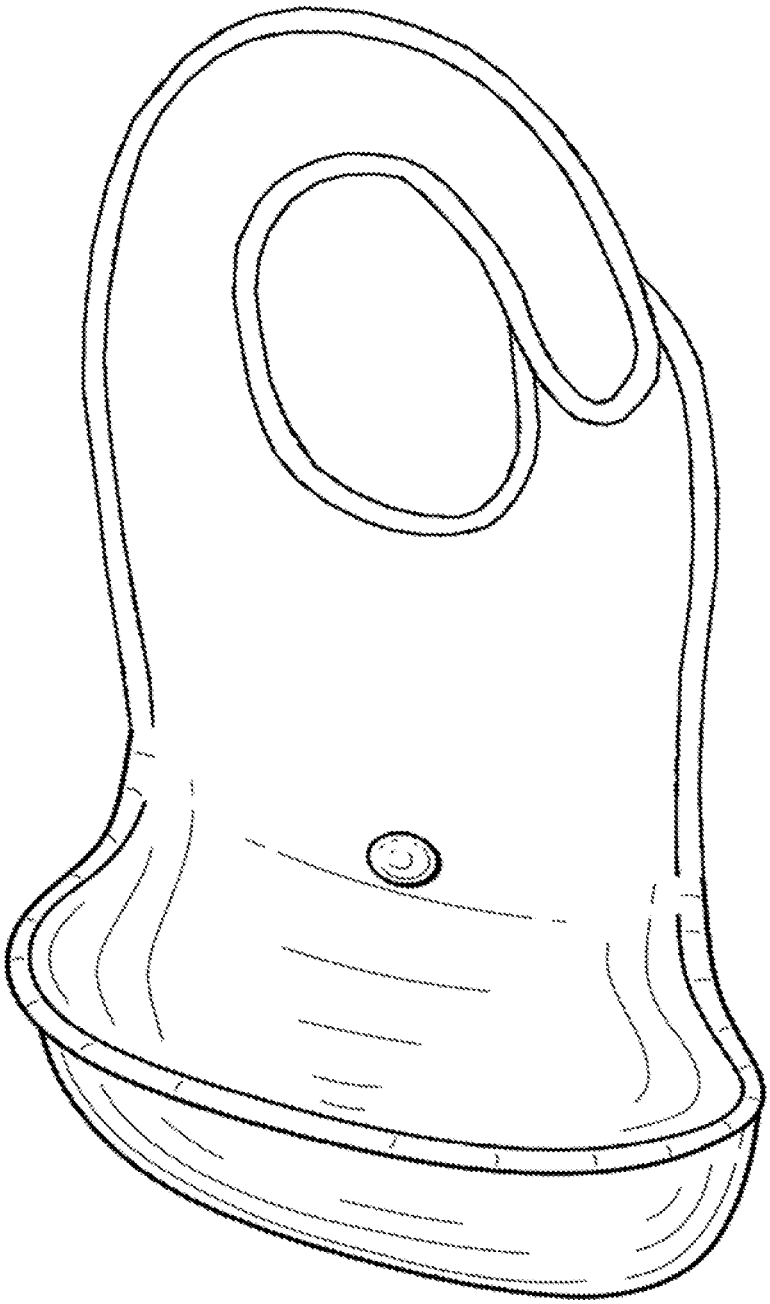
FIG. 2 is a perspective view of the bib according to the invention showing the position of the locking compartment.

The convertible bib 1 is foldable and can be collapsed down and stored in storage pocket 40. Various items can be stored in storage pocket 40, such as spoon for use during outdoor activities. FIG. 1 illustrates a convertible bib 1 having a panel 10 and storage pocket 40. The convertible bib 1 includes a panel 10 having collar appendages 15, 16 that extend and secure around the neck of the infant. The method of having the said collar appendages fastened together is depicted in FIG. 2. Methods of fastening the appendages typically include various Velcro, buttons, hook and loop, or any other fasteners, as long as it is able to secure the bib around the neck of the infant. FIG. 1 also shows the general location of the locking compartment 20, a vital component of the locking mechanism to secure the bib in a folded position. Further description of the methods to the locking mechanism will be discussed in later paragraphs.

Figure 3:
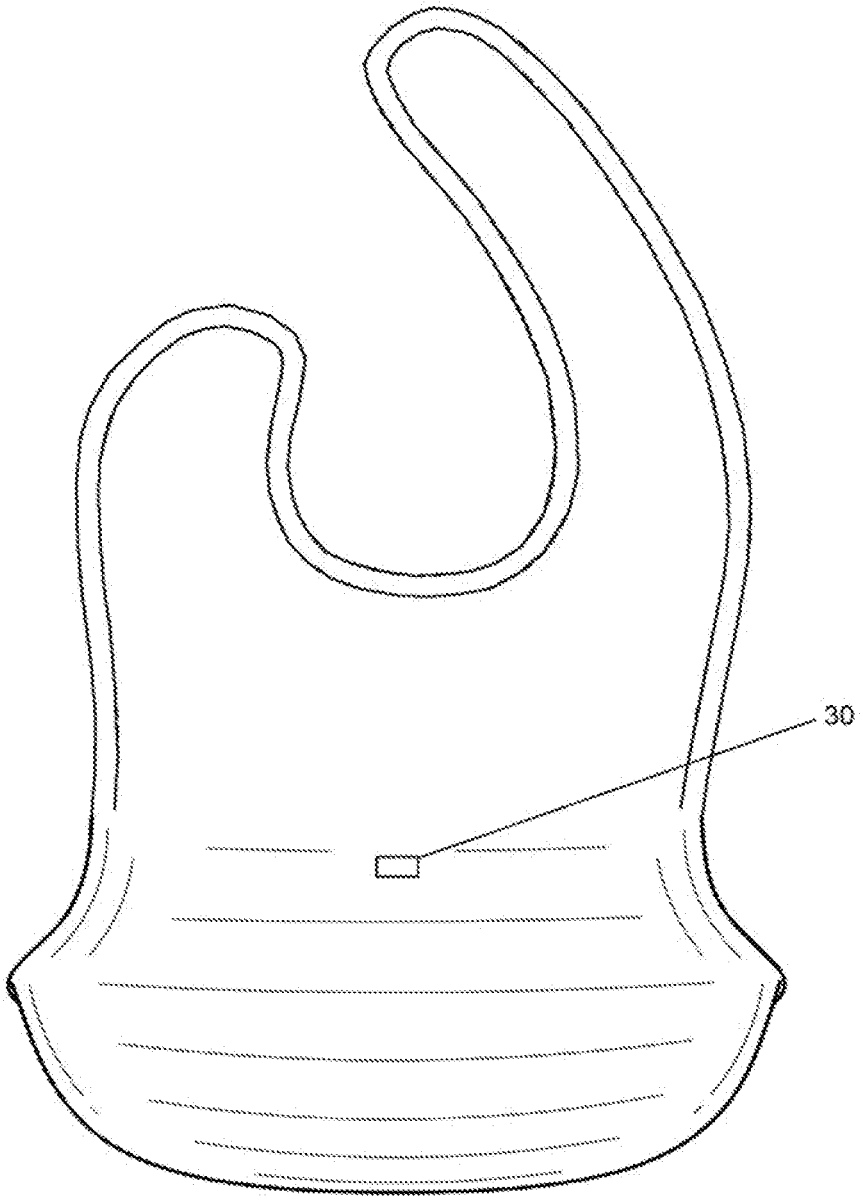
FIG. 3 is a back view of the bib showing the opening of the locking compartment.

FIG. 3 is a posterior view of the bib, revealing the opening 30 to the locking compartment 20. The opening 30 consists of an aperture or slit that is stretchable to various sizes and shapes, in order to meet the protruding tab 25, located in the storage pocket 40. In the depicted embodiment, the opening is a single opening defined by a continuous boundary.

Figure 4:
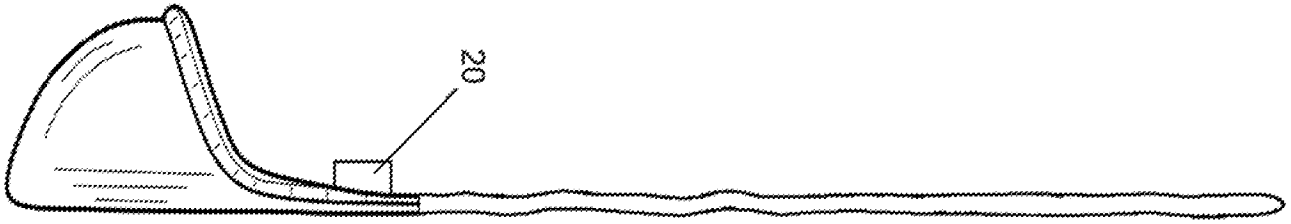
FIG. 4 is a lateral view of the bib, depicting the locking compartment.

FIG. 4 is a lateral view showing the locking compartment 20, positioned on the body 1 of the bib. The locking compartment is made of semi-rigid material that is able to stretched, compressed and decompressed, thereby, allowing morphing of its shape and hence achieving interlocking of protruded tab 25 and locking compartment 20.

Figure 5:
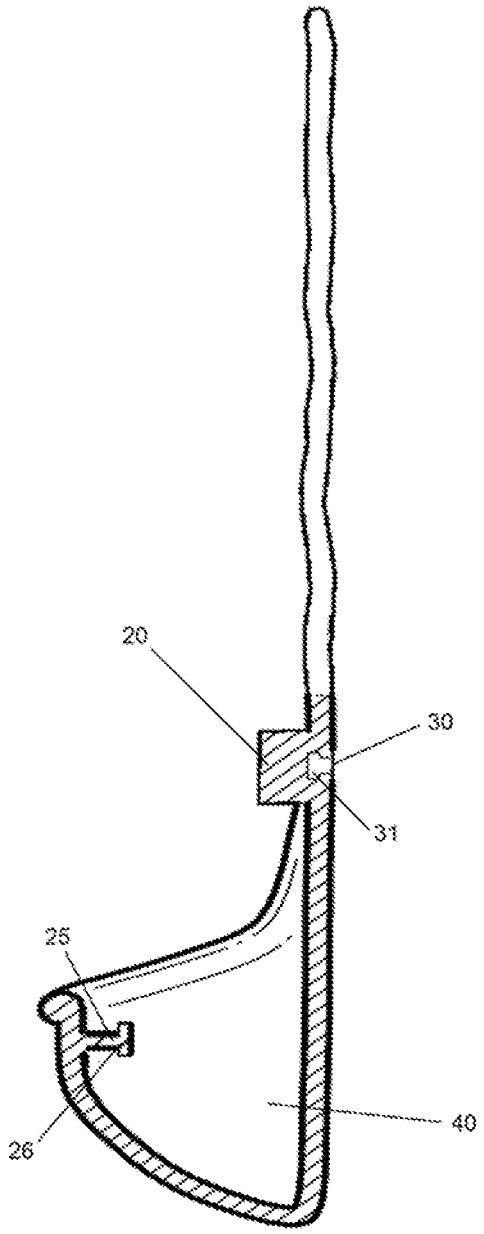
FIG. 5 is a lateral view of a vertical cross-section of the invention, showing the locking compartment, the socket, the opening and the protruded tab.
Figure 6:
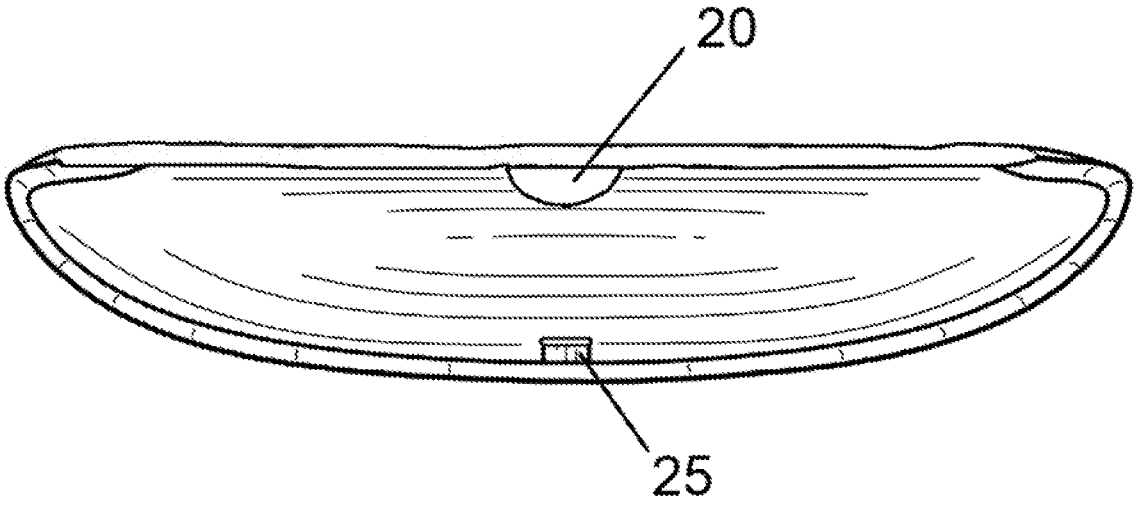
FIG. 6 is a top view of the invention, showing the alignment of the locking compartment and the protruding tab.

FIG. 5 is a cross-section view taken at line A shown in FIG. 1. The locking compartment 20 is positioned on the front side body of the bib 1. The inner structure of locking compartment 20 consists of a socket 31 and opening 30. As depicted, the opening 30 is on a rear surface of the panel 10 and above the storage pocket 40 when the panel 10 is in an unfolded position. The socket 31 is a hollow structure (e.g., defining a hollow chamber) with means to engage and firmly secure the anchor 26 of the said protruded tab 25 when the bib is the folded position. In the depicted embodiment illustrated at least by FIGS. 1-7, the locking compartment is completely enclosed except for the single opening 30. The said protruded tab 25 is generally located in the storage pocket 40, and is aligned respectively on the same vertical axis of the locking compartment 20 (See FIG. 6). As depicted, the protruded tab 25 is disposed below an upper edge of the storage pocket 40, and extends rearward from an inner front surface of the storage pocket 40. It is to be noted that the shape and size of the socket 31 is determined by the stretchability of the material used to for the locking compartment, with the main purpose to firmly secure the anchor 26 of the protruding tab 25.

Figure 7:
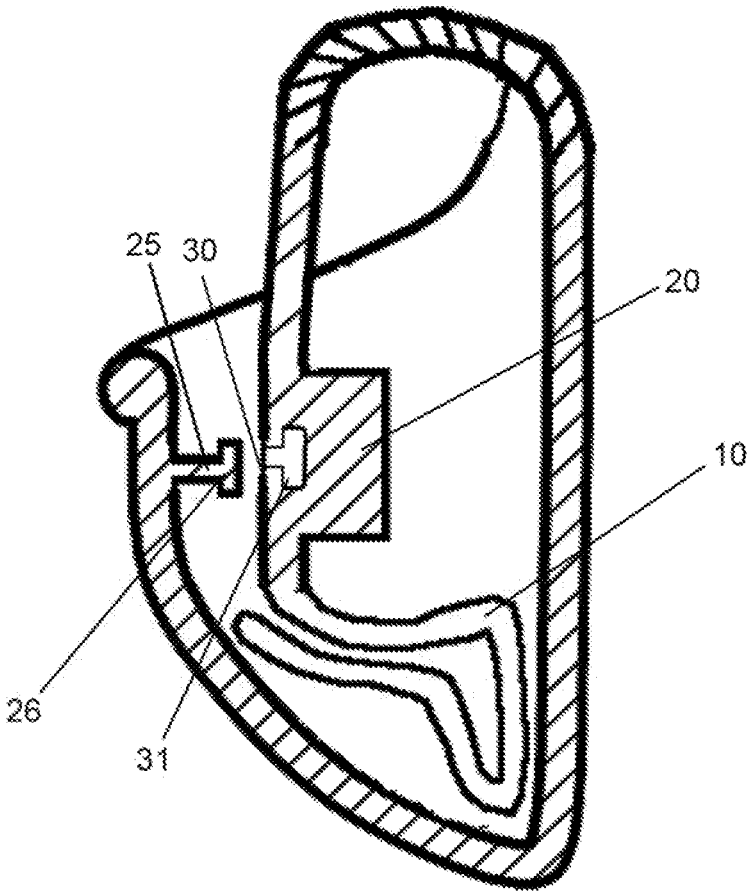
FIG. 7 is a lateral view of a vertical cross-section of the bib in a folded position.

FIG. 7 is a cross-section of a lateral view revealing the bib 1 in a folded position. During the storage operation, the user folds the bib into the storage pocket 40, whereby the panel of the bib 10 is folded into the storage pocket 40 in such a way that the opening 30 is aligned with the protruded tab 25. The user inserts the protruded tab 25 into the locking compartment 20 via the opening 30. When the protruded tab 25 reaches the socket 31, the stretchability and elasticity of the socket 31 engages and secures the anchor 26 of the protruded tab 25. Alternatively, the user may apply pressure such as pinching and bending the locking compartment 20 to expand the inner structures (socket 31 and opening 30) for ease of insertion of the protruded tab 25. By releasing the pressure, the inner structures elastically returning to its initial state which in turn, grabs and secures the anchor 26 of protruded tab 25. The user detaches the protruded tab 25 by again, applying pressure onto the locking compartment 20 which in turn, stretches the inner structures and further releasing the anchor 26, allowing the protruded tab 25 to be pulled out from the locking compartment 20. The protruded tab 25 and its anchor 26 can also be designed to morph their shapes under pressure. The user may apply pressure on the said protruded tab 25 to disengage from socket 31 and release it from the compartment 20 via the opening 30.

Alternatively, the protruded tab can be placed within the locking compartment 20 with an alternate socket placed in the storage pocket 40 to achieve similar interlocking mechanism.

Alternatively, the position of protruded tab and locking compartment can be swapped, wherein the locking compartment is placed in the storage pocket 40, and the protruded tab is located on the body of the bib, to achieve similar interlocking mechanism.

Figure 8:
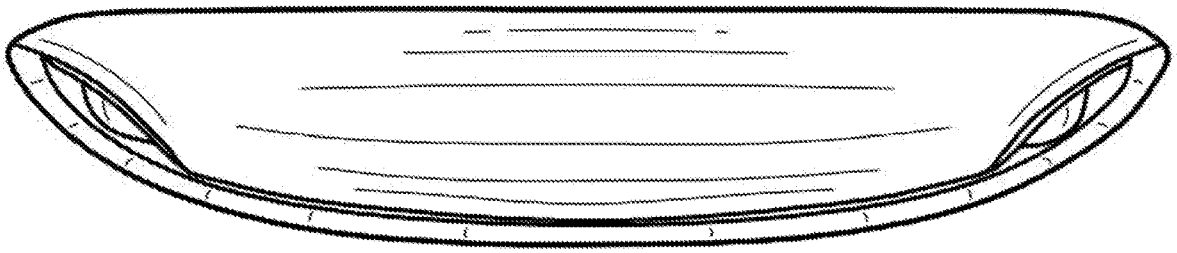
FIG. 8 is a top view of the bib in a folded position.
Figure 9:
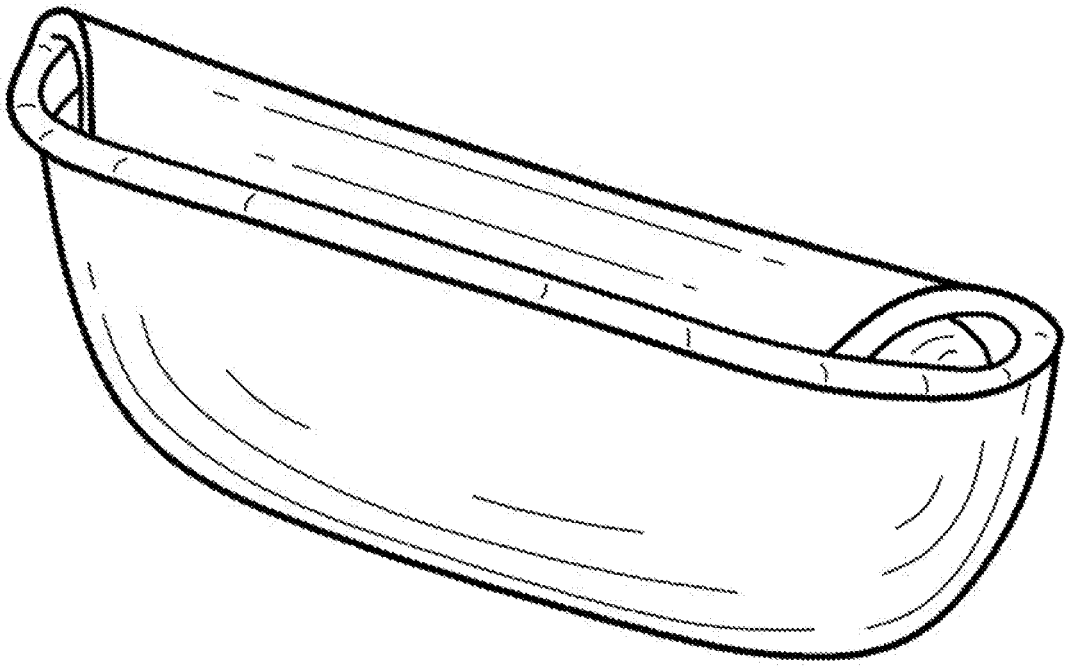
FIG. 9 is a perspective view of the bib in a folded position.
Figure 10:
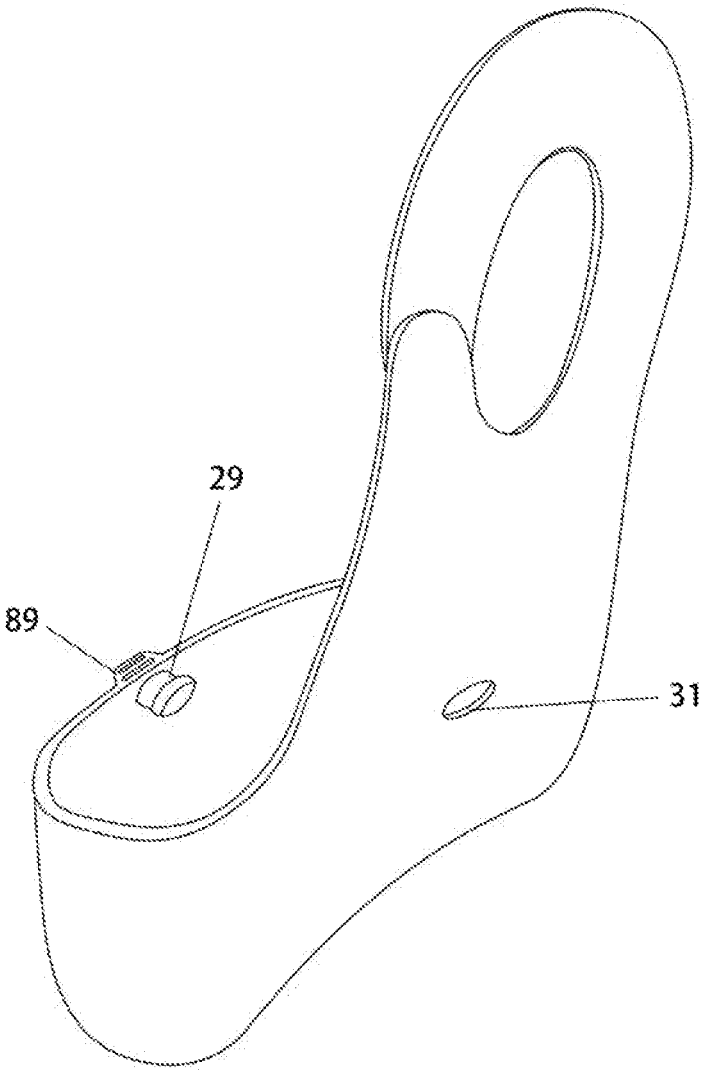
FIG. 10 is a perspective view of the bib in unfolded position, showing a handle at the edge of the storage pocket.

FIG. 8 and FIG. 9 are the top view and perspective view of the bib in fully folded position. While the folded bib generally is in the shape of a "bathtub", it is to be noted that the bib can be manufactured into various shapes. It is to be noted that the entire bib can be manufactured as one piece or as multiple components. The locking compartment 20, protruded tab 25, socket 31, opening 30 and other subsequent components can be manufactured into various sizes, shapes and materials as long as it achieving the said locking effect. The locking compartment 20 can also be made to encase by different resilient materials to achieve a better or optimal locking effect with the protruded tab 25. The protruded tab 29 can further extend to form a handle 89. The said handle 89 is generally located in the vicinity of the protruded tab 29 with means to assist with inserting and removing the protruded tab 29 from the opening 31 of the locking compartment. The handle 89 can be part of the protruded tab 29 or a separate entity. The handle 89 can be manufactured into various sizes, shapes and materials.

As an alternate to the preferred embodiment, the locking compartment 20 can be made hollow to further encase and secure a locking device (not shown). The locking device interact with protruded tab; both can be in forms of, but not limited to, buckle, buttons, fastener, connectors; and may or may not consists of the similar material as the locking compartment 20.

The protruded tab and locking compartment can be placed anywhere on the bib and it is to be noted that there could be one or more than one locking compartments or protruded tabs at any location and may or may not to be aligned with each other. This allows the bib to be folded in various sizes and shapes, in order to accommodate the amount of storage space the user desires.

The invention claimed is:

1. A convertible bib comprising:

a panel, a storage pocket, and a locking mechanism formed from a continuous material;

(a) wherein at least a lower portion of the panel has a continuous front surface and an opposing rear surface;

(b) wherein an upper portion of the storage pocket is contiguous with the lower portion of the panel; and, (c) wherein the locking mechanism comprises:

at least one locking compartment formed from the continuous material and extending from the lower portion of the panel and comprising:

a single hollow socket having a single opening defined by a continuous boundary with an opposite closed end, the single opening providing access into the single hollow socket, the single opening being on the rear surface of the lower portion of the panel and above the storage pocket when the panel is in an unfolded position; and, at least one protruded tab, formed from the continuous material, disposed within the storage pocket below an upper edge of the storage pocket and extending rearward from an inner front surface thereof, wherein:

the continuous material is configured such that the front surface of the panel is a continuous expanse running from an upper portion of the bib and expanding to a top edge portion of the storage pocket such that the single hollow socket of the locking compartment is accessible from the rear surface of the panel, the single opening and the at least one protruded tab are adapted to be brought into register with each other inside the storage pocket when the panel is folded into the storage pocket, and, the at least one protruded tab comprises an anchor at a distal end, wherein the at least one protruded tab and the single hollow socket releasably interlock when the anchor of the at least one protruded tab is sufficiently inserted into the at least one locking compartment, such that the convertible bib is secured in a folded position.

2. The convertible bib according to claim 1, wherein the at least one locking compartment is elastic such that the at least one locking compartment, including the single opening, stretches from an initial state when the anchor is inserted therethrough, and elastically returns to the initial state, thereby releasably securing the anchor of the at least one protruded tab.

3. The convertible bib according to claim 1, wherein the at least one protruded tab further comprises at least one handle.

4. The convertible bib according to claim 1, wherein the storage pocket further comprises at least one handle.

5. The convertible bib according to claim 1, wherein:

the continuous material is elastic, and the at least one locking compartment is configured to stretch from an initial state when the anchor is inserted therethrough, and elastically return towards the initial state when the at least one protruded tab is sufficiently inserted into the at least one locking compartment, thereby releasably securing the anchor of the at least one protruded tab within the at least one locking compartment such that the convertible bib is secured in a folded position.

6. The convertible bib according to claim 1, wherein, when the panel is in an unfolded position, the front surface of the continuous material is configured to conduct fluid on any portion of the front surface into the storage pocket such that spillage onto a child is prevented.

7. A convertible bib comprising;

a panel, a storage pocket, and a locking mechanism formed from a continuous material, wherein the panel is contiguous with an upper rear portion of the storage pocket and wherein the locking mechanism comprises:

a locking compartment formed from the continuous material contiguous with a lower portion of the panel, and having a single hollow socket having a single opening defined by a continuous boundary with an opposite closed end, the single opening providing access into the single hollow socket, and the single opening being on a rear surface of the convertible bib and above the storage pocket when the panel is in an unfolded position; and, at least one protruded tab formed from the continuous material disposed within the storage pocket and extending rearward from an inner surface thereof, wherein the convertible bib is adapted to register the at least one protruded tab and the single opening of the locking compartment inside the storage pocket when an upper portion of the convertible bib is folded thereinto.

8. The convertible bib according to claim 7, wherein the at least one protruded tab further comprises an anchor.

9. The convertible bib according to claim 7, wherein the at least one protruded tab further comprises at least one handle.

10. The convertible bib according to claim 7, wherein the storage pocket further comprises at least one handle.

11. The convertible bib according to claim 7, wherein:

the continuous material is elastic, and the at least one locking compartment is configured to stretch from an initial state when an anchor at a distal end of the at least one protruded tab is inserted therethrough, and elastically return towards the initial state when the at least one protruded tab is sufficiently inserted into the at least one locking compartment, thereby releasably securing the anchor of the at least one protruded tab within the at least one locking compartment such that the convertible bib is secured in a folded position.

12. A convertible bib comprising a body formed from a continuous material, wherein the body comprises at least one locking mechanism comprising:

a locking compartment formed from the continuous material with the body and defining a single hollow socket with a single entry into the single hollow socket, the single hollow socket defined by a continuous boundary with an opposite closed end, the locking compartment contiguous with an upper portion of the body and positioned above a storage pocket of the body, and, at least one protruded tab of the continuous material disposed within the storage pocket and extending rearwardly from an inner front surface thereof, wherein:

the body is adapted to register the at least one protruded tab with the single entry when the upper portion of the body is folded into the storage pocket, and, the continuous material is configured such that a front surface of the body is a continuous expanse running from an upper portion of the bib and expanding to a top portion of the storage pocket such that the single hollow socket is accessible from a rear surface of the body.

13. The convertible bib according to claim 12, wherein the single hollow socket of the at least one locking mechanism further secures an anchor of the at least one protruded tab, when inserted through the single entry, to releasably secure the convertible bib in a folded position.

14. The convertible bib according to claim 12, wherein the at least one protruded tab further comprises at least one handle.

15. The convertible bib according to claim 12, wherein the storage pocket further comprises at least one handle.

16. The convertible bib according to claim 12, wherein:

the continuous material is elastic, and, the at least one locking compartment is configured to stretch from an initial state when an anchor at a distal end of the at least one protruded tab is inserted therethrough, and elastically return towards the initial state when the at least one protruded tab is sufficiently inserted into the at least one locking compartment, thereby releasably securing the anchor of the at least one protruded tab within the at least one locking compartment such that the convertible bib is secured in a folded position.

* * * * *